US010167176B2

(12) United States Patent
Willim et al.

(10) Patent No.: US 10,167,176 B2
(45) **Date of Patent: *Jan. 1, 2019**

(54) AUTOMATIC ERECTING OF A CRANE

(71) Applicant: Liebherr-Werk Ehingen GmbH, Ehingen/Donau (DE)

(72) Inventors: Hans-Dieter Willim, Ulm-Unterweiler (DE); Engelbert Haebe, Ehingen (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 459 days.

This patent is subject to a terminal disclaimer.

(21) Appl. No.: 14/830,604

(22) Filed: Aug. 19, 2015

(65) Prior Publication Data

US 2016/0052753 A1 Feb. 25, 2016

(30) Foreign Application Priority Data

Aug. 20, 2014 (DE) ..... 10 2014 012 457

(51) Int. Cl.

| | |
|---|---|
| ***B66C 13/18*** | (2006.01) |
| ***B66C 23/04*** | (2006.01) |
| ***B66C 13/22*** | (2006.01) |
| ***B66C 23/82*** | (2006.01) |

(52) U.S. Cl.

CPC ..... *B66C 13/18* (2013.01); *B66C 13/22* (2013.01); *B66C 23/04* (2013.01); *B66C 23/82* (2013.01)

(58) Field of Classification Search

CPC ..... B66C 13/00; B66C 13/18; B66C 13/22; B66C 15/00; B66C 23/00; B66C 23/04; B66C 23/06; B66C 23/34; B66C 23/342; B66C 23/82; B66C 23/88; B66C 25/00

See application file for complete search history.

(56) References Cited

U.S. PATENT DOCUMENTS

| | | | | |
|---|---|---|---|---|
| 3,371,799 | A * | 3/1968 | Brownell | B66C 23/72 212/230 |
| 8,720,709 | B2 | 5/2014 | Willim | |
| 2012/0312767 | A1 | 12/2012 | Bohnacker et al. | |
| 2014/0019016 | A1* | 1/2014 | Miyoshi | B66C 13/18 701/50 |
| 2016/0221799 | A1* | 8/2016 | Muench | B66C 13/18 |

FOREIGN PATENT DOCUMENTS

| | | | |
|---|---|---|---|
| DE | 19606109 | A1 | 6/1997 |
| DE | 102010020016 | A1 | 11/2011 |
| DE | 102011107754 | A1 | 12/2012 |

* cited by examiner

*Primary Examiner* — Minh Truong
*Assistant Examiner* — Juan J Campos, Jr.
(74) *Attorney, Agent, or Firm* — McCoy Russell LLP

(57) ABSTRACT

The present disclosure relates to a method for the automatic telescoping of the boom system of a crane, in particular of a mobile crane, having at least one telescopic boom, and having a rope and a winch for pivoting the boom. The method comprises measuring an actual value of the boom angle of the boom and actuating, in particular automatically, the winch in dependence on the measured boom angle.

4 Claims, 7 Drawing Sheets

AUTOMATIC ERECTING OF A CRANE

CROSS REFERENCE TO RELATED APPLICATION

This application claims priority to German Patent Application No. 10 2014 012 457.6, entitled "Automatic Erecting of a Crane," filed on Aug. 20, 2014, the entire contents of which is hereby incorporated by reference in its entirety for all purposes.

TECHNICAL FIELD

The present disclosure relates to a method for the automatic telescoping of the boom system of a crane, in particular of a mobile crane, having at least one telescopic boom.

BACKGROUND AND SUMMARY

Cranes having boom systems are known in the prior art. On the assembly of corresponding cranes, the boom elements of the boom system are moved or telescoped from an assembly state to a fully assembled state. The assembly state can in this respect, for example, be a state in which the boom system is substantially placed on a storage area or a ground area. The crane is not able to carry out crane work in this respect. The fully assembled state is achieved after a corresponding moving of the boom elements. The boom system can in this respect substantially be removed from the storage area or ground area and can be arranged at least partly angled from the storage area or ground area. Parts of the boom system such as a main boom can in this respect be arranged substantially vertically.

One potential issue with the moving of the boom system is that the moving of a boom system is a complex sequence of movements which has to be carried out reliably so that no toppling over of, or damage to the crane occurs. This requires experienced operating staff and a high time effort in the carrying out of the moving. It is therefore the object of the present disclosure to simplify the moving of a crane of the category or to simplify its boom system and to improve the movement procedure.

This object is achieved in accordance with the present disclosure by a method for the automatic telescoping of the boom system of a crane, in particular of a mobile crane, having at least one telescopic boom, and having a rope and winch for pivoting the boom, the method comprising the steps of measuring with a first sensor an actual value of the boom angle of the boom forming an acute angle relative to a horizontal plane; and actuating, in particular automatically, the winch in dependence on the measured boom angle.

It is hereby advantageously made possible to monitor and/or to regulate/control the telescoping of the boom system in a simplified manner such that a tilting of or damage to the crane is prevented.

It is conceivable in this respect in an example embodiment that at least one desired value of the boom angle is predefined and that the winch unwinds in an accelerated manner on the telescoping out of the boom if the actual value exceeds the desired value and the winch may unwind in a delayed manner on the telescoping out of the boom if the actual value falls below the desired value. Alternately, the winch may wind up in a delayed manner on the telescoping in of the boom if the actual value exceeds the desired value and the winch may wind up in an accelerated manner on the telescoping in of the boom if the actual value falls below the desired value.

The angle between the boom or the main boom of the crane and the horizontal (that is, the ground) can in this respect be represented by the boom angle. Desired values which are different or the same can in this respect be predefined for every equipping state of the crane. Desired values which are different or the same can equally be predefined for the telescoping in and for the telescoping out of the boom.

The detection and measurement of the actual value of the boom angle of the boom in this respect allows a monitoring of the crane kinematics especially adapted to the crane geometry and to the weight distribution. The boom angle can, for example, be determined from measured values from angle transmitters at the boom. The guying which serves the stabilization of the boom system can in this respect be tensioned so that the forces transmitted by the guying can likewise be used for monitoring the crane kinematics.

In another example embodiment, the method further comprises the steps of measuring with a second sensor an actual value of the guying frame angle of a guying frame forming an acute angle relative to the horizontal plane by determining, based on the measurements of the boom angle and the guying frame angle, the intermediate angle of the guying frame and of the boom; and actuating, in particular automatically, the winch in dependence on the intermediate angle of the guying frame and the boom.

In accordance with this example embodiment, a crane can also be telescoped in accordance with the method, in which crane and the winch is arranged, for example, at a revolving deck of the crane and not at a co-moved boom element such as the telescopic boom itself. In this respect, the intermediate angle is now determined as the control parameter and the winch is actuated so that limit values are not exceeded. In this respect, that angle is represented by the intermediate angle which is spanned between the guying frame and the boom.

It is conceivable in a further example embodiment that at least one desired value of the intermediate angle is predefined and that the winch winds up on the telescoping if the actual value exceeds the desired value. Additionally or alternatively, the winch may unwind on the telescoping if the actual value falls below the desired value. Additionally, or optionally, the winch may be automatically actuated on a luffing of the boom.

It is advantageously hereby avoided that the intermediate angle of the guying frame and of the boom becomes too small or too large, whereby the stability of the crane could be reduced. Additionally or alternatively, it can be ensured by the actuation of the winch on the luffing of the boom that the rope or the guying follows the luffing movement of the boom and does not counteract it, or that a correct guying can be ensured despite a luffing movement taking place.

It is conceivable in a further example embodiment that the hook height relative to the ground and/or the luffing tip angle relative to the ground or relative to the boom and/or the force carried by a guying and/or support is measured as an additional control parameter. It is conceivable in another example embodiment that the boom system is controlled on moving such that the at least one control parameter and/or the actual value or the actual values is/are within specific intervals or within a specific interval at least at times during the moving.

The crane or individual crane drives can then be controlled, in particular automatically, such that the corresponding control parameters are held within specific intervals. This means that the hook height is automatically held at level on the telescoping and/or that the luffing tip likewise automatically maintains a constant angle relative to the ground or to the horizontal on the telescoping. Analogously, the force carried by the guying and/or support can also be automatically held constant by a corresponding control of crane drives or of a crane drive. The operation of the crane is hereby facilitated for the operating staff on its assembly and the risk of an incorrect assembly at which the crane can topple over or can be otherwise damaged is minimized.

Further advantages and details of the method will be shown with reference to the Figures.

DETAILED DESCRIPTION

Figure 1:
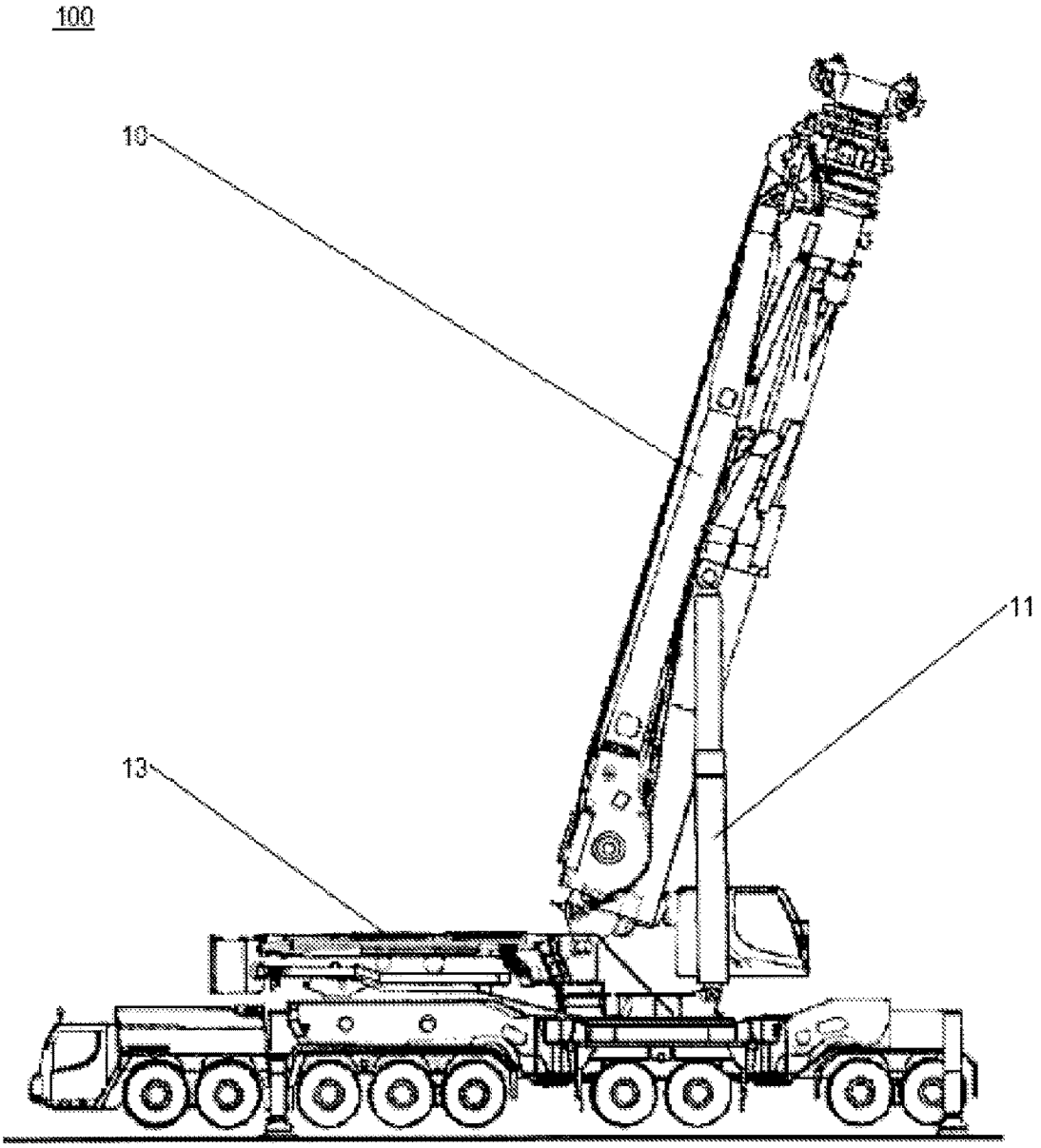
FIG. 1 shows telescopic cranes in accordance with the prior art.

FIG. 1 shows a telescopic crane 100 in accordance with the prior art which can be configured as a mobile crane 100. In this respect, a telescopic boom or main boom 10 is luffably connected to a revolving deck 13 in an articulated manner. The boom 10 is adjusted by means of one or more hydraulic cylinders 11 and the outreach is thus changed.

Figure 2:
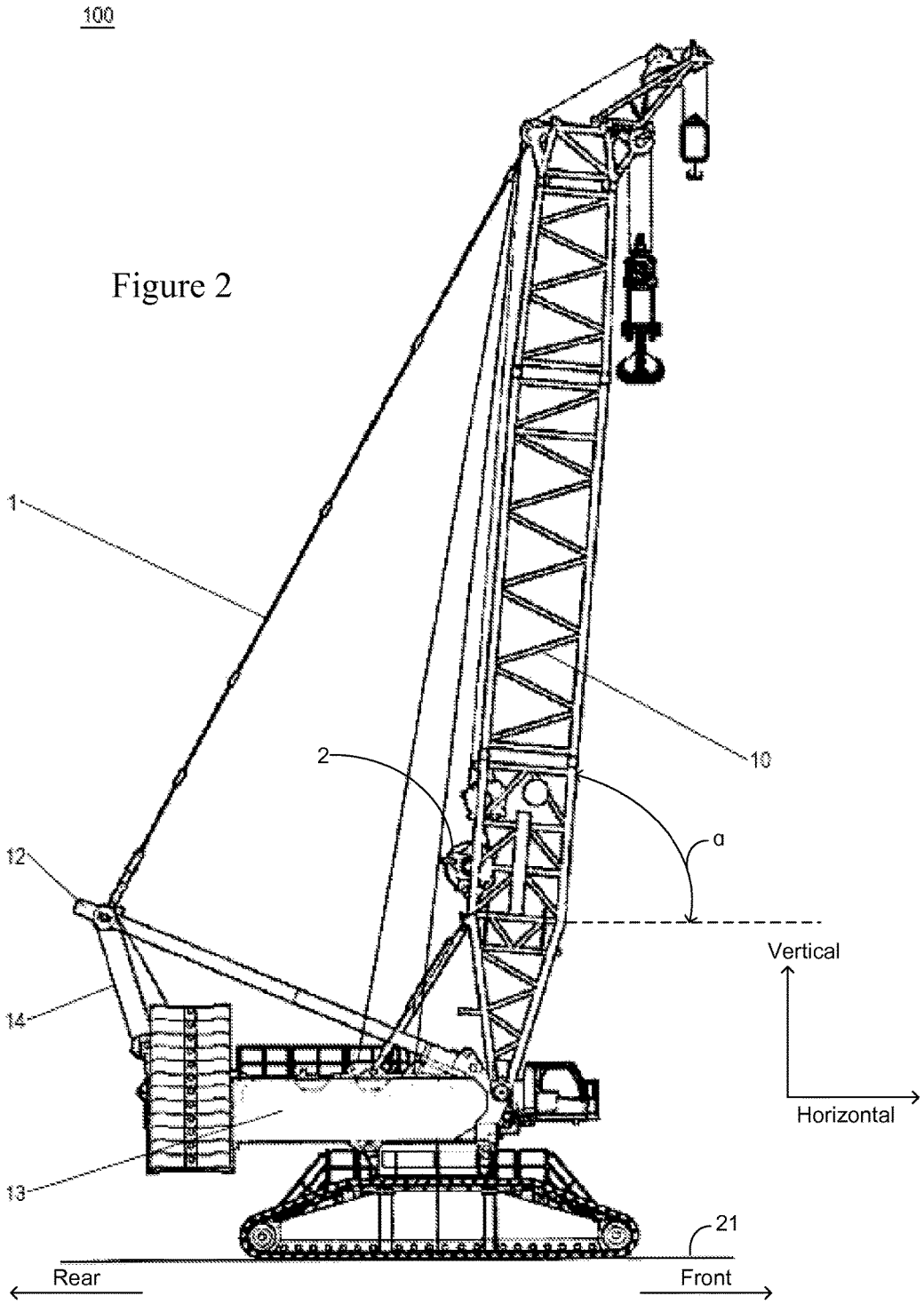
FIG. 2 shows an example embodiment of a lattice mast crane.

FIG. 2 shows a lattice mast crane 100 in which the boom 10 is held by a guying via the guying frame 12. In this simplest case, the guying in this respect comprises a rope 1. An adjustment device 14, which can be configured as a pulley block, is located between the guying frame 12 and the rear revolving deck end of the revolving deck 13. The adjustment device 14 allows the boom angle $\alpha$ and thus the outreach to be varied. The boom angle $\alpha$ can in this respect be an angle between the boom 10 and the horizontal (shown here as dashed lines), in particular an angle in the luffing plane of the boom 10. The lattice mast crane further includes a winch 2.

To operate a telescopic boom 10 with a guying, that is in the widest sense a combination of the two cranes 100 from FIGS. 1 and 2, the system of FIGS. 1 and 2 has to be modified. With a telescopic boom 10, the guying has to lengthen or shorten under load since the boom length varies on the telescoping.

Figure 3:
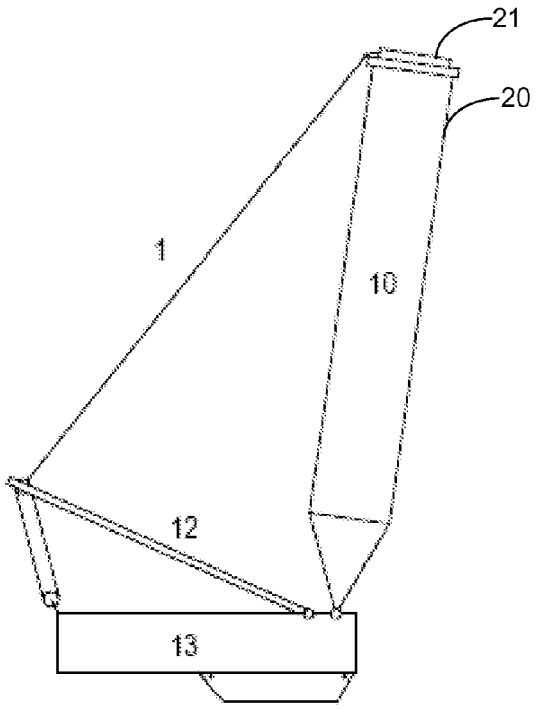
FIG. 3 shows a schematic representation of a telescoping procedure.
Figure 4:
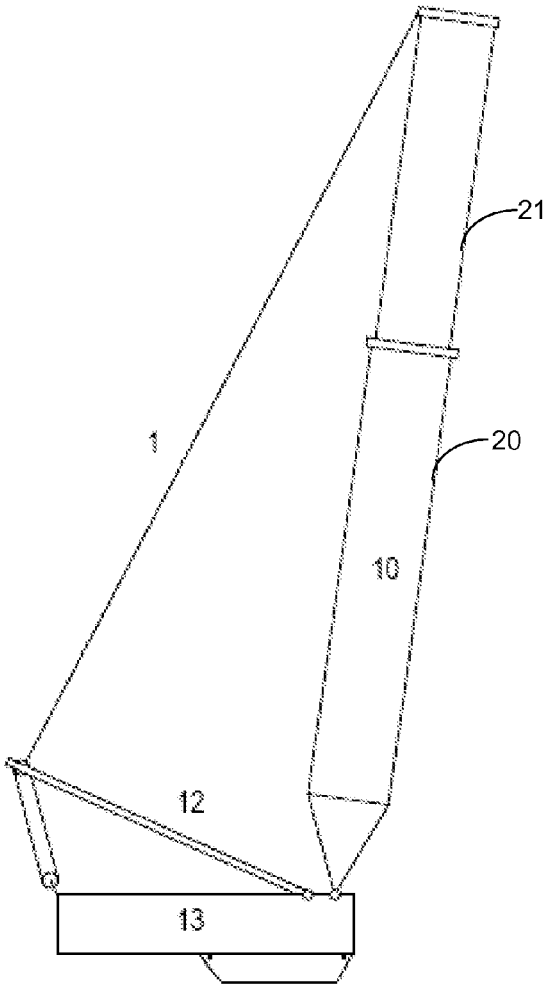
FIG. 4 shows a schematic representation of a telescoping procedure.

FIGS. 3 and 4 show a schematic representation of a corresponding telescoping procedure in which a rope 1 is provided between the guying frame 12 and the boom 10. The boom is coupled to the revolving deck 13 via the rope 1 and the guying frame 12. The boom 10 is at least partially telescoped out and thereby lengthened in FIG. 4. So that there is no damage to the rope 1 or to the boom 10, the length of the rope 1 has to be varied by means of the winch 2, not shown here, for the telescoping.

The length variation of the rope 1 has to take place synchronously with the telescoping procedure to hold the boom 10 in position. If the rope 1 of the guying lengthens or shortens too slowly or too fast during the telescoping, the boom angle varies and the following problems arise: If the boom angle approaches the 90° position, or the perpendicular position, there is the risk that the boom 10 will fall backward, or counter-clockwise, i.e., to the left, in FIGS. 3 and 4. If the boom angle becomes too small, the friction between the individual telescope sections 20, 21 increases, which has the effect in the extreme case that the telescopic cylinder is overloaded.

Figure 5B:
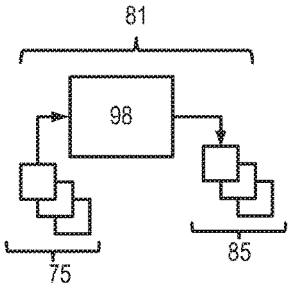
FIG. 5B shows a representation of a control system of the crane of FIG. 5A.
Figure 5A:
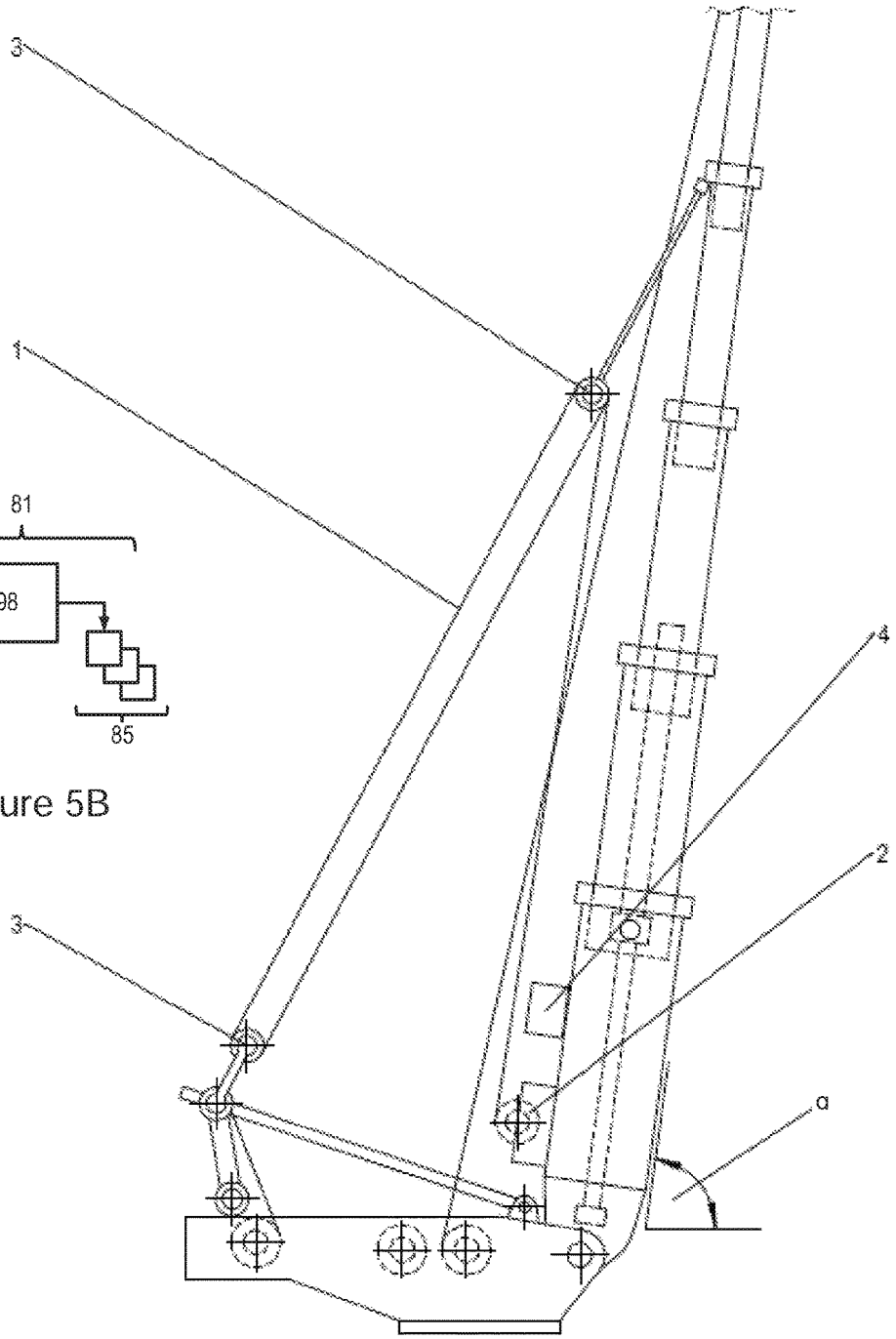
FIG. 5A shows a representation of a crane for telescoping in accordance with the present disclosure.

To make possible the required length change of the guying or the rope 1 of the guying, the guying can, as shown in FIG. 5, comprise a rope 1, a winch 2 and a pulley block 3. The winch 2 has to unwind the rope 1 on the telescoping out to lengthen the guying or the rope 1. The winch 2 has to wind up the rope 1 correspondingly on the telescoping in to shorten the guying. The boom angle is determined via a sensor 4 and is compared with a predefined desired value. If there is a difference between the desired value and the actual value, the winch has to react accordingly.

For example, upon telescoping out, if the desired value is exceeded (that is, if the actual value is higher than the desired value), the winch 2 may unwind faster. As another example, upon telescoping out, if the_desired value is fallen below (that is, if the actual value is lower than the desired value), then the winch may unwind more slowly.

As another example, upon telescoping in, if the desired value is exceeded (that is, if the actual value is higher than the desired value), then the winch may wind up more slowly. In comparison, upon the telescoping in, if the desired value is fallen below (that is, if the actual value is lower than the desired value), then the winch may wind up faster.

Figure 6B:
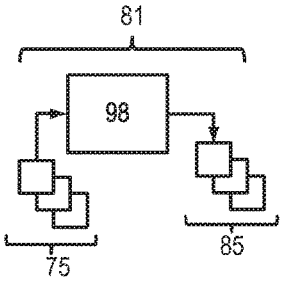
FIG. 6B shows a representation of a control system of the crane of FIG. 6A.
Figure 6A:
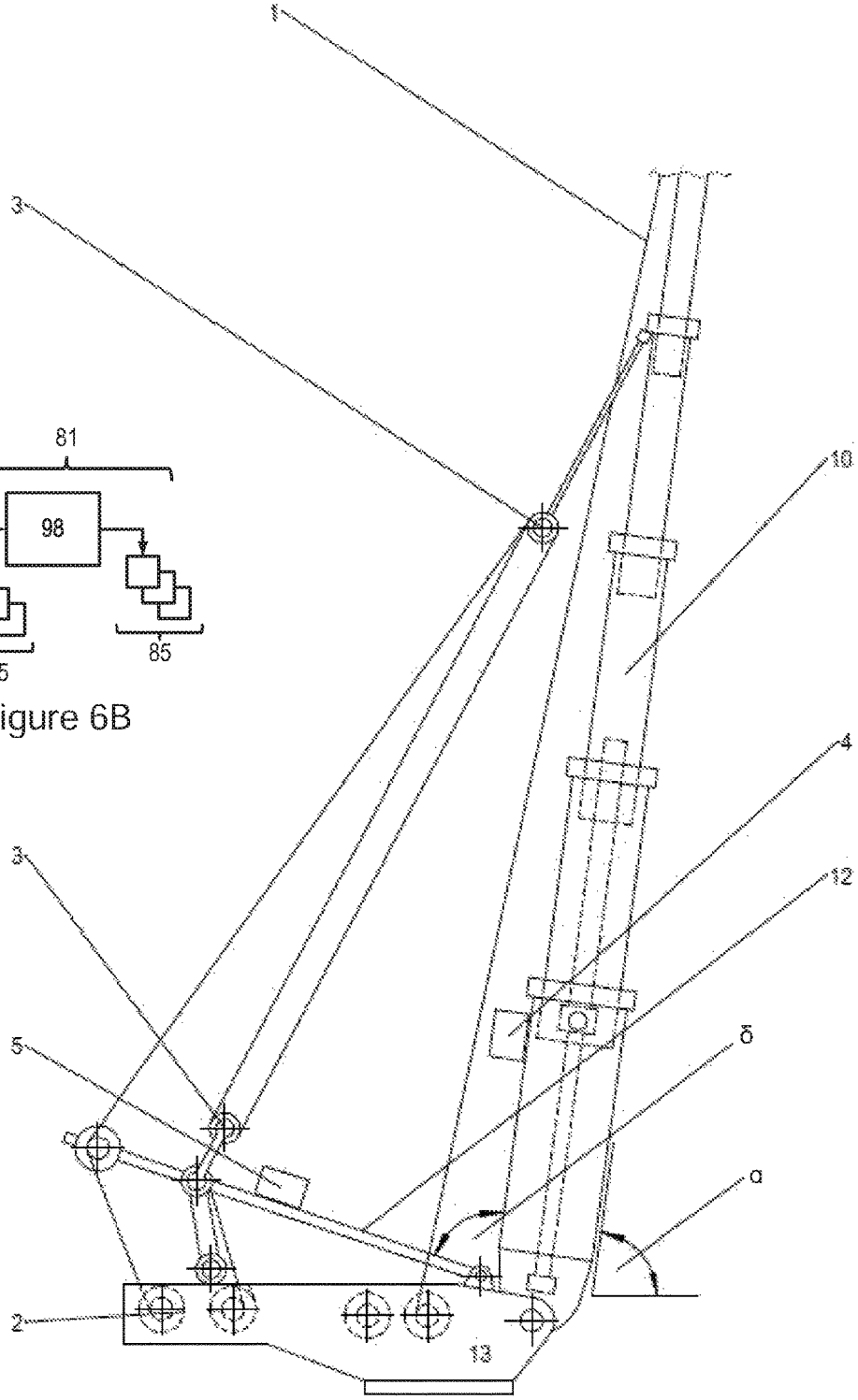
FIG. 6A shows a representation of a crane for telescoping in accordance with the present disclosure.

If the rope 1 is guided, as shown in FIG. 6, via the guying frame 12, with the winch 2 being in or at the revolving deck 13, the winch 2 does not only have to respond or be actuated on the telescoping, but also on the luffing (that is, raising or lowering) of the boom 10. A second sensor 5 may be required in this case. The angle $\delta$ between the guying frame 12 and the boom 10 can be determined using the sensors 4, 5 and can be compared with a predefined desired value. If there is a difference between the desired value and the actual value, the winch 2 has to react accordingly. For example, if the desired value is exceeded (that is, actual value is higher than desired value), then the winch may wind up rope. As another example, if the desired value is fallen below (that is, actual value is lower than desired value), the winch may unwind rope.

If the winch 2 is within the guying triangle of the boom 10, the guying frame 12 and the guying or rope 1 or if the winch 2 is provided at the boom 10 or at the guying frame 12, for example, as shown in FIG. 5, the winch 2 only has to respond or be actuated on the telescoping.

In one example, the cranes of FIGS. 5 and 6 may include a control system 81 having various modules and/or interfaces that include control routines stored in the memory of the electronic control system 81. The electronic system 81 may be communicatively coupled with sensors 75 (such as sensors 4 and 5), actuators 85 (such as winch 2), and/or displays for receiving data including input information, sensor information, and for sending actuator control and/or display information. The electronic control system may include a processor and memory 98, in combination with sensors and actuators, to carry out the various controls described herein.

Figure 7:
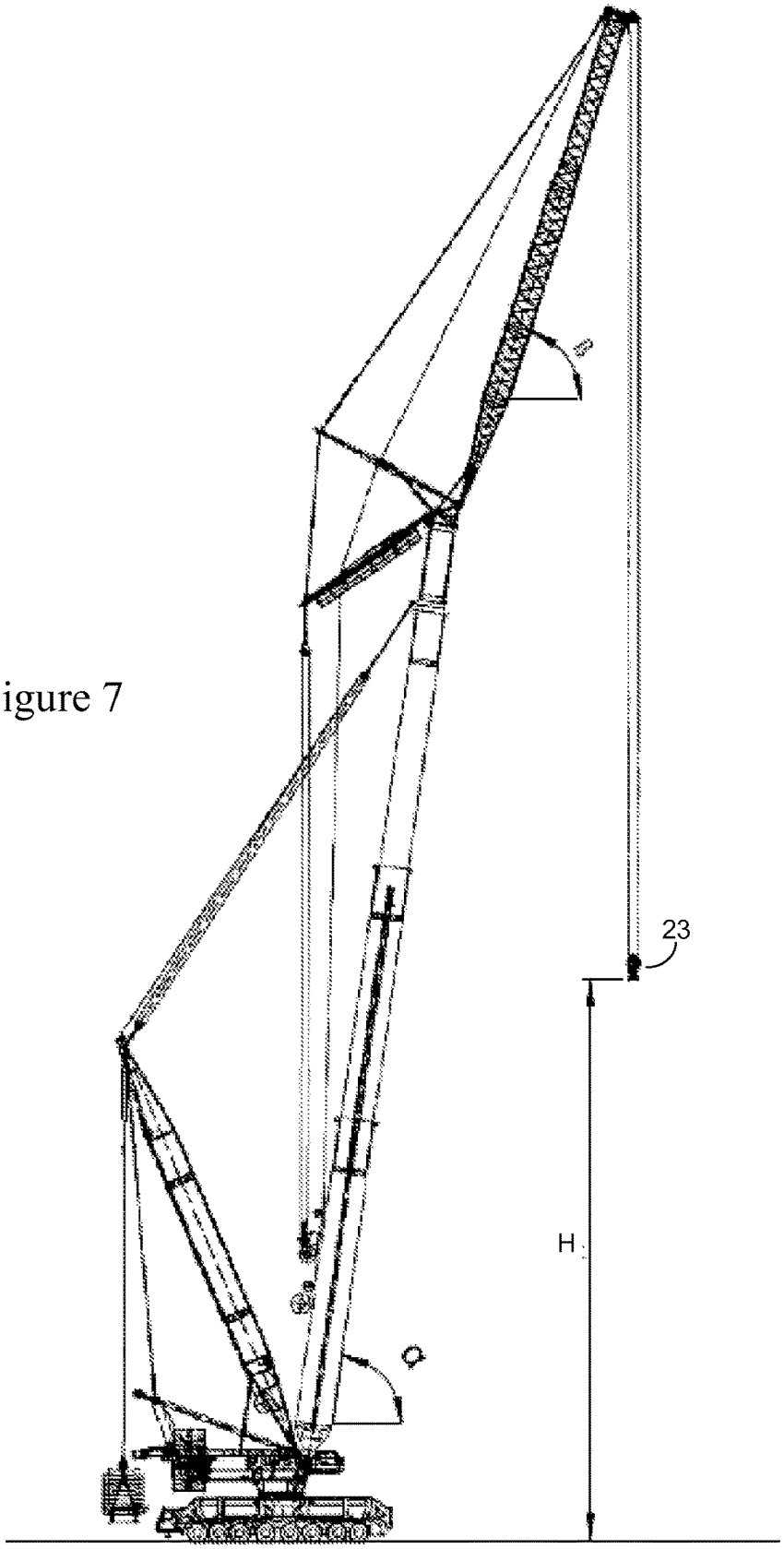
FIG. 7 shows a representation of possible control parameters of a crane.

FIG. 7 shows a representation of different possible control parameters of a crane 100. Provision can be made in this respect that the hook height H, i.e., the height of a hook 23 of the crane above the ground, is determined or measured, for example, and that a hoist rope winch is accordingly controlled on the telescoping such that the hook height H remains constant in this respect.

It is equally conceivable to measure the luffing tip angle β and to hold it constant or in a desired or specific range during the telescoping procedures by a corresponding control of the actuator system of the luffing tip. The boom angle α, to which reference was previously made, is also shown for clarity in FIG. 7.

Figure 8:
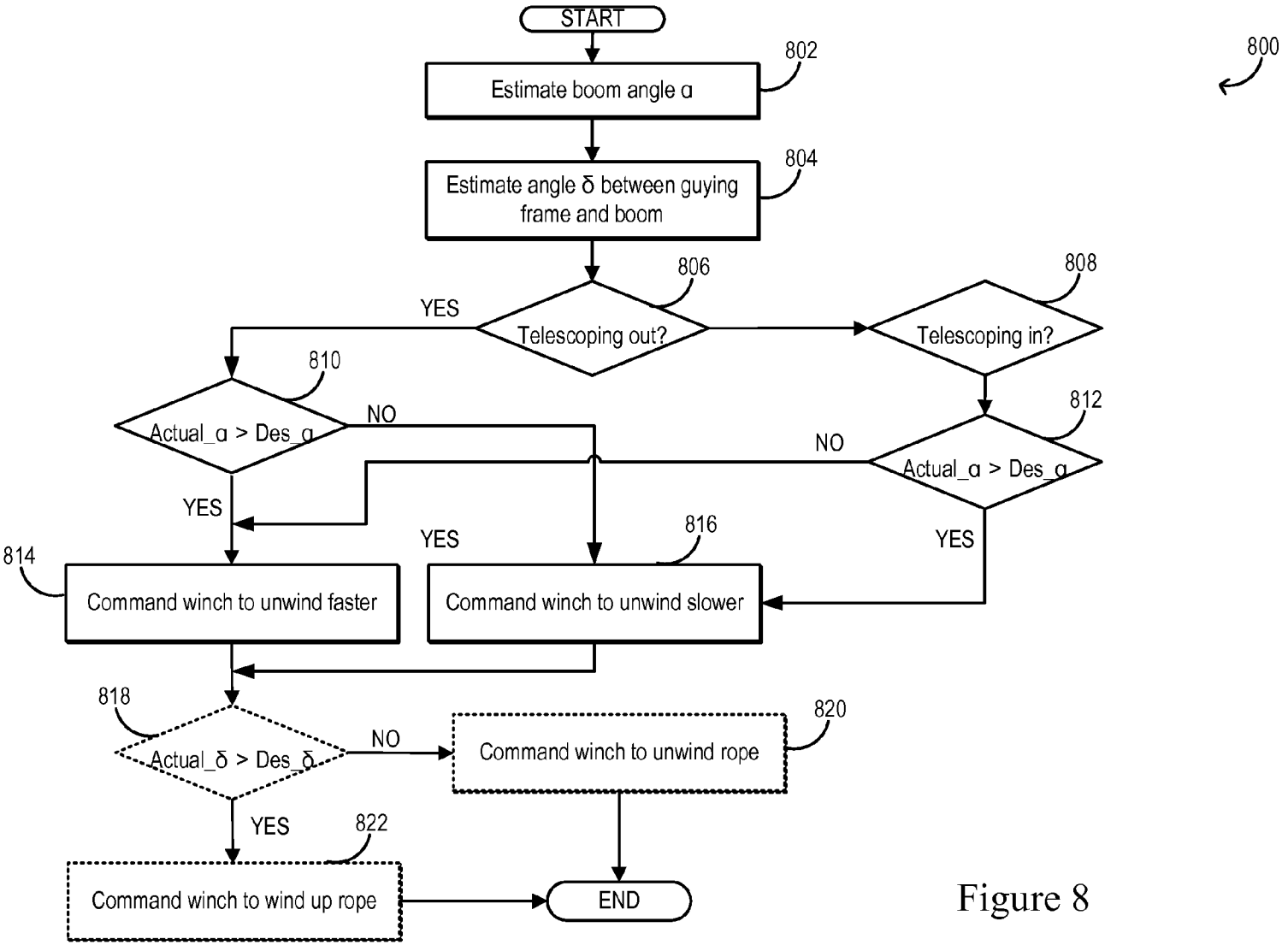
FIG. 8 shows a high level flowchart of a method for operating a crane winch during a telescoping procedure in accordance with the present disclosure.

FIG. 8 shows an example method 800 for adjusting the operation of a winch during telescoping of a crane. At 802, the method includes measuring and/or estimating a boom angle α. For example, boom angle α may be estimated based on the output of sensor 4 of FIGS. 5 and 6. At 804, the method includes measuring and/or estimating an intermediate angle δ between the guying frame and the boom of the crane (such as guying frame 12 and boom 10 of FIGS. 5 and 6). As an example, intermediate angle δ may be estimated based on the output of sensor 5 of FIGS. 5 and 6. At 806, it may be determined if telescoping out (of the boom) is requested. If yes, then at 810, the actual or measured value of boom angle α (Actual_α) may be compared to a predefined or desired value of the boom angle (Desired_α). Specifically it may be determined if the desired value is exceeded. If the actual value of α is higher than the desired value of α on the telepscoping out, then at 814, the winch is commanded to unwind at a faster rate. In comparison, if the desired value is fallen below, that is, if the actual value of α is lower than the desired value of a, then at 816, the winch is commanded to unwind at a slower rate. If telescoping out is not confirmed at 806, at 808, it may be determined if telescoping in (of the boom) is requested. If yes, then at 812, the actual or measured value of boom angle α (Actual_α) may be compared to a predefined or desired value of the boom angle (Desired_α). Specifically it may be determined if the desired value is exceeded. If the actual value of α is higher than the desired value of α on the telepscoping out, then the method moves to 816 where the winch is commanded to unwind at a slower rate. Else, if the desired value has been fallen below, that is, if the actual value of α is lower than the desired value of α, then the method moves to 814 where the winch is commanded to unwind at a faster rate.

If the guying rope of the crane is guided, such as in the case of the crane configuration shown at FIG. 6, then the winch has to be actuated in response to telescoping as well as luffing of the boom. In such a configuration, the method proceeds to 818 wherein the measured intermediate angle δ between the boom and the guying frame (Actual_δ) is compared to a predefined or desired value of δ. Specifically it may be determined if the desired value is exceeded. If the actual value of δ is higher than the desired value of δ, at 822, the winch is commanded to wind up rope. In comparison, if the desired value is fallen below, that is, if the actual value of δ is lower than the desired value of δ, then at 820, the winch is commanded to unwind rope. The method then ends and exits.

The method in accordance with the present disclosure is suitable for moving boom systems having at least one telescopic boom at a crane 100, in particular at a mobile crane 100. The crane 100 can comprise an undercarriage and a superstructure or a revolving deck 13. The main boom 10 can be luffably connected to the superstructure in an articulated manner. Drives can be provided for the possible movements or luffing movements or telescopic movements. A spatial guying can be provided at the boom 10.

The crane operator can set the crane control to "automated telescoping". In this situation, the crane operator actuates the control lever for telescoping the boom 10; the winch 2 is then automatically actuated in dependence on the measured angle or on the measured angles.

The telescoping of the main boom 10 and optionally the tracking of the fly boom or of the hook can thus take place in an automated fashion to a substantial extent. The telescoping in and out can analogously takes place in the reverse order. The rocker or the fly boom can be held in a specific angular window or at a specific angle in the telescoping procedure. The regulation can take place using the angle transmitter at the main boom and at the accessory, e.g. at the fly boom at the luffing tip or at the guying frame.

The invention claimed is:

1. A method for automatic telescoping of a boom system of a crane having at least one telescopic boom, and having a rope and a winch for pivoting the boom, the method comprising:

measuring with a first sensor an actual value of a boom angle of the boom forming an acute angle relative to a horizontal plane;

actuating, automatically, the winch based on the measured boom angle;

measuring with a second sensor an actual value of a guying frame angle of a guying frame forming an acute angle relative to the horizontal plane;

determining, based on the measurements of the boom angle and the guying frame angle, an intermediate angle between the guying frame and the boom; and actuating, automatically, the winch based on the intermediate angle between the guying frame and the boom, and wherein the crane is a mobile crane.

2. The method in accordance with claim 1, wherein at least one desired value of the boom angle is predefined, and wherein the winch unwinds in an accelerated manner on the telescoping out of the boom if the actual value exceeds the desired value and the winch unwinds in a delayed manner on the telescoping out of the boom if the actual value falls below the desired value, or the winch winds up in a delayed manner on the telescoping in of the boom if the actual value exceeds the desired value and the winch winds up in an accelerated manner on the telescoping in of the boom if the actual value falls below the desired value.

3. The method in accordance with claim 1, wherein at least one desired value of the intermediate angle is predefined and wherein the winch winds up on the telescoping if the actual value exceeds the desired value, the winch unwinds on the telescoping if the actual value falls below the desired value, and the winch is automatically actuated on a luffing of the boom.

4. The method in accordance with claim 1, wherein one or more of: a hook height relative to ground, a luffing tip angle relative to the ground or relative to the boom, and a force carried by a guying and/or support is measured as an additional control parameter, and wherein the actuating of the winch is further adjusted based on the additional control parameter.

* * * * *